US005271624A

United States Patent [19]

Sciortino

[11] Patent Number: 5,271,624

[45] Date of Patent: Dec. 21, 1993

[54] SHOT ON GOAL PRACTICE AID

[76] Inventor: J. Paul Sciortino, Rd. #1, Box 71 G, Bartlet Hill, Jeffersonville, Vt. 05464

[21] Appl. No.: 21,263

[22] Filed: Mar. 1, 1993

[51] Int. Cl.[5] ..... A63B 69/00

[52] U.S. Cl. ..... 273/411

[58] Field of Search ..... 273/26 A, 29 A, 57.2, 273/400–402, 411

[56] References Cited

U.S. PATENT DOCUMENTS

| | | | |
|---|---|---|---|
| 708,569 | 9/1902 | Manley | 273/26 A |
| 3,312,467 | 4/1967 | Dawson | 273/26 A |
| 3,856,298 | 12/1974 | Frantti | 273/57.2 |
| 3,993,306 | 11/1976 | Scott | 273/29 A |
| 3,997,159 | 12/1976 | Malhas | 273/29 A |
| 4,295,648 | 10/1981 | Stromback | 273/26 A |
| 4,921,257 | 5/1990 | Heller | 273/401 |
| 4,948,147 | 8/1990 | Pallanca | 273/29 A X |
| 5,181,725 | 1/1993 | Leras et al. | 273/402 |

*Primary Examiner*—Paul E. Shapiro
*Attorney, Agent, or Firm*—John J. Welch, Jr.

[57] ABSTRACT

A modified sling commonly used in unmodified form for load bearing modified to the extent that one end, a top end consists of a closed eye loop and the other end, a bottom end is flat. The flat bottom end of the device is folded onto the body of the device and a pouch later filled with weighted material is stitched from the fold and then stitched shut thus forming a weighted bottom end. Two VELCRO straps are held to the body of the device by VELCRO hookholds. When the device is to be used, the closed eye loop end is threaded through netting before or after first turning it over the crossbar of a goal. The weighted bottom end of the device is then threaded through the closed eye loop end and the device knotted to the crossbar so as to then hang down almost to the ground and the device's VELCRO straps are positioned up and/or down the body of the device at locations where it is desirable for them to be held by their respective hookholds to the body of the device so as to thereby define the size of upper and lower rectangular corners of a goal to where shots on goal are to be directed.

6 Claims, 2 Drawing Sheets

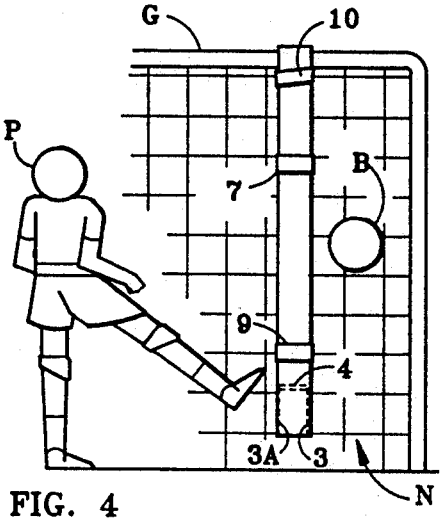
FIG. 4
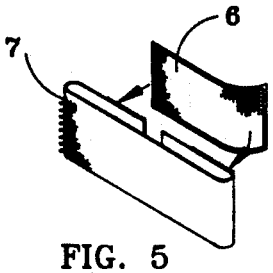
FIG. 5
FIG. 11
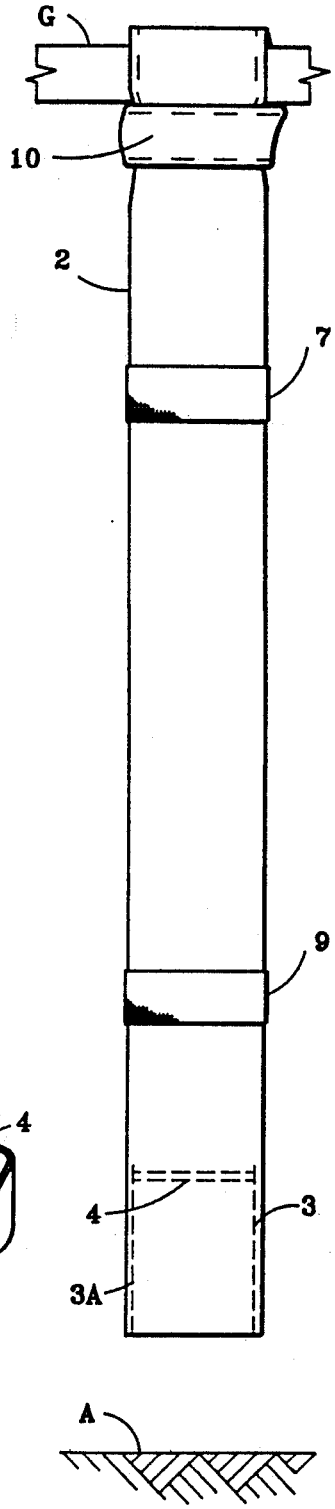
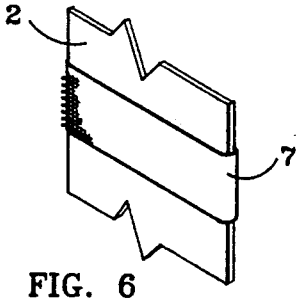
FIG. 6
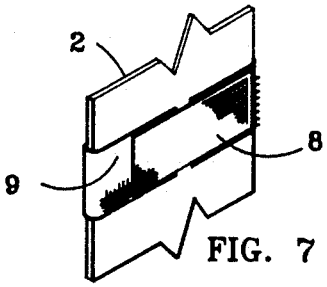
FIG. 7
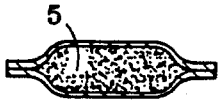
FIG. 8
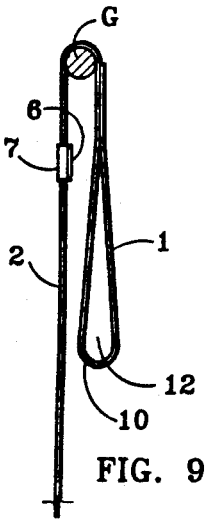
FIG. 9
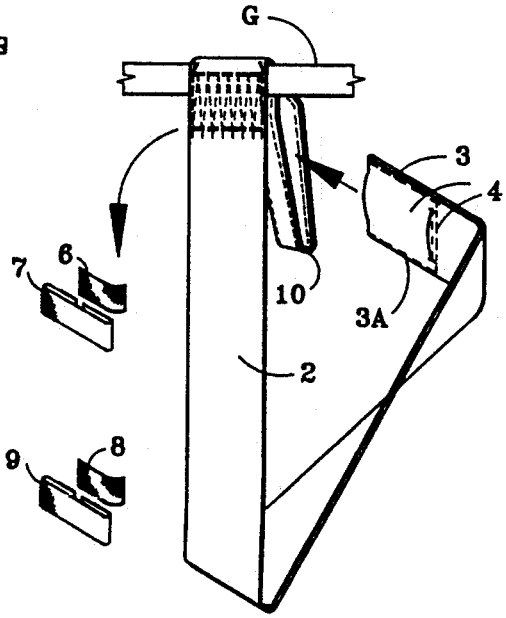
FIG. 10

SHOT ON GOAL PRACTICE AID

REFERENCES TO FEDERALLY SPONSORED RESEARCH AND DEVELOPMENT

There are no relationships in respect of the instant invention to any federally sponsored research and development.

BACKGROUND OF THE INVENTION

1. Field of the Invention:

The instant invention is one of those types of training devices serving to facilitate enhanced performance of athletic endeavors.

2. Possible Prior Art:

Prior art that may bear somewhat on the instant invention would be perhaps the following references:

| Inventor | Invention | Pat. No. | Date |
|---|---|---|---|
| 1. Forrest | Place-Kicking Football Receiving Target | 4,068,846 | 1/17/78 |
| 2. Pallanca | Soccer Target | 4,948,147 | 8/14/90 |
| 3. Heller | Soccer Training Device | 4,921,257 | 5/1/90 |
| 4. Tallent et al | Ball and Target Net Apparatus | 4,905,996 | 3/6/90 |
| 5. Bauer et al | Target Teaching Aid | 4,783,070 | 11/8/88 |
| 6. Wheatcroft | Game Target and Playing Method | 4,949,979 | 8/21/90 |
| 7. Griggs | Hockey Target | 4,245,843 | 1/20/81 |
| 8. Haley | Practice Device For Golfers | 5,062,640 | 11/5/91 |
| 9. J. Makar | Golf Ball Flight Arresting Device Including A Vertically Adjustable Aiming Target | 3,197,208 | 7/27/65 |

A SUMMARY OF THE INVENTION

1. A Brief Description of the Invention:

The instant invention consists of a closed eye loop with a tapered top side which closed eye loop is one end of a modified load bearing sling made of a heavy cordura nylon material. The bottom end of the modified sling is folded up onto the body of the sling and stitched thereto forming a pouch. The pouch is then filled with a weighted material and then stitched shut. Each one of two VELCRO bands are held by one VELCRO hookhold each to the body of the modified sling now the body of the invention. A player utilizing the invention first threads the tapered top side of the closed eye loop end of the invention through netting on a goal and then over the goal's crossbar or over the goal's crossbar and then through the netting. Then the weighted bottom end of the invention is inserted into and then pulled through the eye of the closed eye loop end and a knot is thereby formed allowing the invention to hang down from the crossbar. The weighted bottom end hanging close to the ground on which the goal is located prevents the invention from flopping about in the wind or currents of air. The invention's position on the crossbar from one end of the crossbar to the other end of the crossbar and the location of the VELCRO bands up and down the hanging length of the body of the invention determines the size of the rectangular upper and lower corners of the goal to which a player can practice kicking a ball or shooting a puck, etc.

2. Objects of the Invention:

Such games as soccer, hockey, lacrosse and the like are fast paced games that require resort to highly developed and very refined scoring skills that need to be called upon by players when under normal game conditions, scoring opportunities arise often only within the framework of split seconds amidst the confusion naturally created by a converging crowd of offensive and defensive players all moving at high rates of speed. Scoring success, as might be reasonably suspected, invariably requires a goodly amount of time spent practicing attacking a goal with well-placed corner kicks in the case of soccer or throws in the case of lacrosse or corner shots with a puck in the case of games such as hockey and the like.

The instant device readily facilitates the achievement of the foregoing objectives. It is truly revolutionary in the field encompassing such practice aids especially in light of its ready adjustability, to wit, back and forth along a goal's crossbar and up and down the device's body with respect to its two velcro straps to thus readily define the perimeters of target spaces on goal as large or as small as may be desired and especially as well in light of its ready portability. It is relatively light in weight and can be tightly folded for placement in a small carrying bag at the end of every practice session thereby obviating vandalism or theft of the device. Finally, unlike with all other such practice aids, the instant device can be used during a practice simulating actual game conditions with a goalkeeper guarding a goal during such practices.

A DESCRIPTION OF THE INVENTION

FIG. 4 is a view of an athlete shooting or kicking a ball on goal utilizing the invention hung from the crossbar of the goal with netting.

FIG. 5 is an isolated view of one of the invention's two pieces of VELCRO strapping held to a broken section of the body of the invention.

FIG. 6 shows in frontal view one of the invention's two pieces of VELCRO strapping held to a broken section of the body of the invention.

FIG. 7 shows in posterior view the one of the invention's two VELCRO hookhold that holds in place that hookhold's corresponding piece of VELCRO strapping to a broken section of the body of the invention.

FIG. 8 is a bottom cross sectional view of the closed pouch formed by stitching the bottom end of the invention to the body of the invention after folding the bottom end up against the body. There is also shown weighted material inside the pouch.

FIG. 9 is an isolated lateral view of the invention draped over the crossbar of a goal.

FIG. 10 is an isolated frontal view of the invention depicting with arrows how the weighted bottom end of the invention is threaded through the eye of the invention's closed eye loop end so as to secure the invention to a portion of the crossbar of a goal shown in broken section.

FIG. 11 is an isolated frontal view of the intact invention secured to a portion of the crossbar of a goal shown in broken section.

A DESCRIPTION OF THE PREFERRED EMBODIMENT

Figure 1:
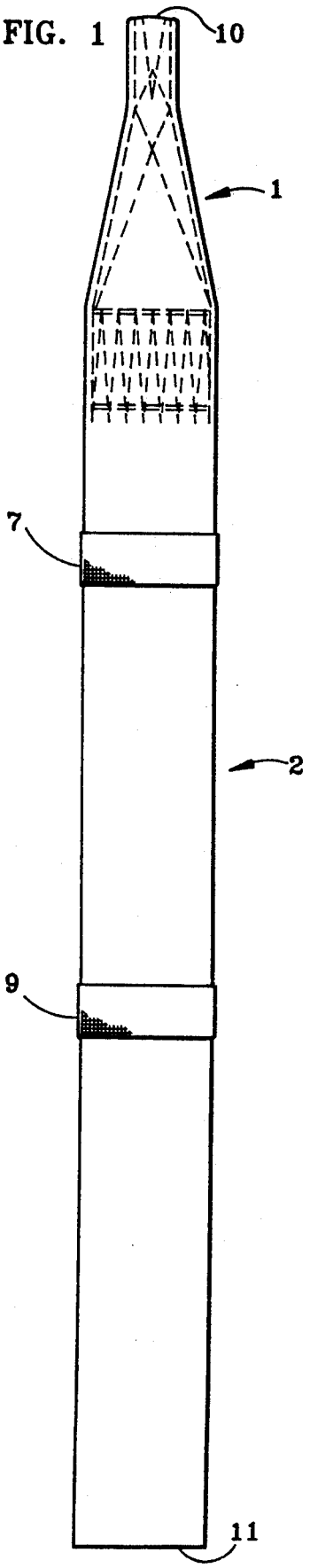
FIG. 1 is a frontal view which shows the closed eye loop top end of the modified sling precursor of the invention, the body of the modified sling, to wit, a modified sling with length and its unfolded bottom end together with two pieces of VELCRO strapping.
Figure 2:
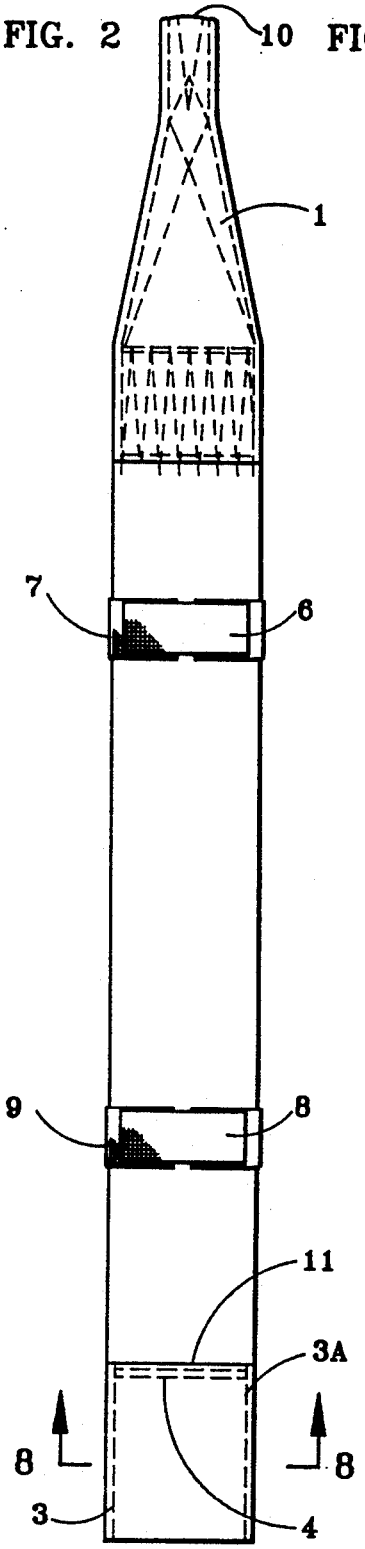
FIG. 2 is a posterior view of the intact invention showing the closed pouch feature of the invention stitched from the folded bottom end of the modified sling. The invention's two pieces of VELCRO strapping are also shown again.
Figure 3:
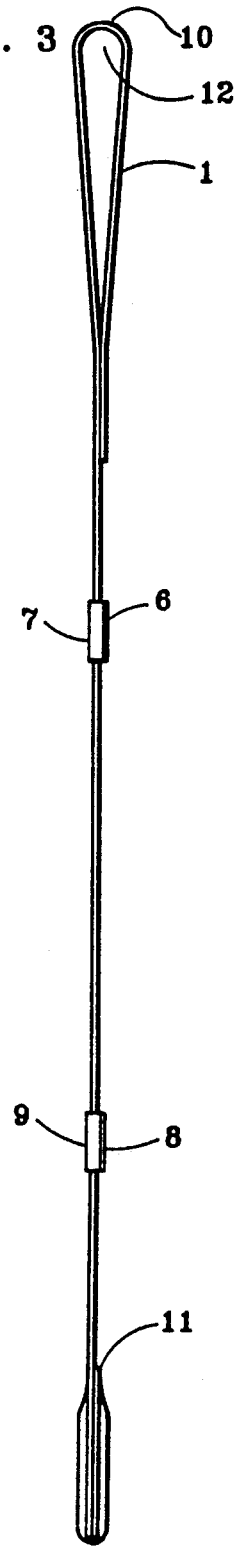
FIG. 3 is a lateral view of what is seen in FIG. 2.

FIG. 1 is a frontal view of some of the integral parts of the instant device. The closed eye loop end 1 with tapered top side 10 is typically made from heavy cordura nylon material which is used to make sturdy load bearing slings used to support the weight of heavy materials such as are commonly used within the construction industry. Body 2 as shown also in FIG. 1 of which closed eye loop 1 is one end is made of the same material. In essence, a sturdy load bearing sling consisting of two closed eye loop ends is modified by cutting off one close eye loop end so that the modified end is then flat. FIG. 2 is a frontal view of the intact instant device. The lower end 11 of the device's body 2 as seen in FIG. 1 is folded up onto the length of body 2 and sturdily stitched thereto with suitable stitching 3 and 3*a* as can be moreover seen in FIG. 2. After end 11 has been so folded up onto body 2 and stitched in place by way of stitching 3 and 3*a* as noted above, the pouch so formed is filled with a weighted material 5 such as sand or pellets, and, the pouch is then sturdily stitched permanently shut by way of stitching 4. Weighted material 5 could be placed in a permanently sealed bag and the bag then put into the pouch before permanently stitching the pouch shut. Also seen in FIG. 1 and FIG. 2 are VELCRO straps 7 and 9. FIG. 3 is a lateral view of the instant device. The permanently shut pouch filed with weighted material 5 formed by stitching end 11 against body 2 is seen in FIG. 3. Also seen in FIG. 3 are VELCRO straps 7 and 9 held taught to body 2 by VELCRO hookholds 6 and 8 respectively. The eye 12 in closed eye loop end 1 is also seen in FIG. 3. FIG. 4 shows a soccer player P kicking a ball B towards netting N affixed to a goal G. The instant device is therein shown knotted to goal G at tapered top side 10 of closed eye loop end 1 and in use by player P. FIG. 5 shows in isolated view VELCRO strap 7 in apposition to VELCRO hookhold 6. FIG. 6 is an isolated frontal view of VELCRO strap 7 affixed to a broken section of the invention's body 2. FIG. 7 shows in an isolated posterior view, VELCRO hookhold 8 holding VELCRO strap 9 fast to a broken section of the body 2 of the invention. VELCRO straps 7 and 9 and VELCRO hookholds 6 and 8 are identical in shape and composition and are hence interchangeable. FIG. 8 is a broken cross sectional view of the permanently shut pouch formed as noted above and shown filled with weighted material 5. FIG. 9 is an end view of the crossbar of goal G over which the invention has been slung. Tapered top side 10 of closed eye loop end 1 is threaded through netting affixed to goal G by a player P while standing in front of goal G. Then, player P reaches over the top of goal G and pulls tapered top side 10 from behind the netting N over the top of the crossbar of goal G so that tapered top side 10 and closed eye loop 1 are then in front of the netting on the same side of goal G as player P. Player P could have opted instead to hang the invention from the crossbar of goal G by placing tapered top side 10 over the top of the crossbar and then pulling it through the netting. Tapered top side 10 makes threading of closed eye loop 1 through netting much easier than would be the case if the top side of closed eye loop 1 were not tapered. At any rate, the weighted bottom end of body 2 consisting of the abovenoted permanently shut pouch is then threaded-through eye 12 of closed eye loop 1 as can be noted with resort to the arrow in FIG. 10. VELCRO straps 7 and 9 are removed then re-affixed to the body 2 and then held thereto by VELCRO hookholds 6 and 8 after completion of the threading maneuver noted as being initiated in FIG. 10, completion of which maneuver results in the instant device then being supported by a knot on the crossbar of goal G and hanging lengthwise with its pouched weighted bottom end in proximity to ground A as can been seen with resort to FIG. 11. The weighted pouched end of body 2 serves to minimize floppiness of the instant invention in windy weather, and, further to facilitate a return of the device to its original hanging position if it is impacted by a player, ball or puck. The desired positioning of the device at points along the length of the crossbar of goal G and the desired positioned adjustments of VELCRO straps 7 and 9 along body 2 serve to define the desired areas of the upper and lower rectangular corners on goal that player P will strive to kick ball B to during practice. The effectiveness of player P as a scorer on goal is enhanced as that player's ability to predictably direct a ball to progressively smaller rectangular corner areas on goal develops through long and focused practice sessions utilizing the instant device for just such a purpose. One's ability to score on goal in the presence of a goalie is greatly enhanced by that person's ability to place a ball from an initial position in front of a goal to a relatively small extreme upper or extreme lower corner of that goal away from where the goalie is positioned.

The above-described embodiment of the instant device is particularly well suited to serve as a practice aid for soccer players. The device is however readily suited as well for service as a practice aid in defining the areas of extreme upper and lower right and left hand corners of goals utilized in other games such as lacrosse, hurling, shinty, bandy, handball, field hockey, roller hockey and ice hockey.

Finally, a lighter weight nylon material can readily be used in the manufacture of the instant device instead of utilizing the abovementioned heavy cordura nylon material.

I claim:

1. A shot on goal practice aid, comprising:

a. a two-ended elongated piece of heavy clothlike material, a top end of which is in the form of a closed loop and a bottom end of which is flat with the length of the body of said elongated piece between both ends being longer in measure than the perimeter of said top end;

b. a first line of stitching serving to completely stitch the lowest portion of the first one of the two long edges of said body of said elongated piece to a higher portion of said first one of the said two long edges of said body of said elongated piece after folding said lowest portion up against said higher portion;

c. a second line of stitching parallel to said first line of stitching serving to completely stitch the lowest portion of the second one of the said two long edges of said body of said elongated piece to a higher portion of said second one of said two long edges of said body of said elongated piece after folding said lowest portion of said second one of the said two long edges up against said higher portion of said second one of the said two long edges;

d. weighted material placed into the pouch formed by said first line of stitching and said second line of stitching;

e. a third line of stitching perpendicular to and abutting the said first line of stitching and perpendicular to and abutting the said second line of stitching serves to permanently close said pouch containing said weighted material;

f. a first piece of VELCRO strapping that folds about said body of said elongated piece;

g. a first piece of VELCRO hooking material to hold the two lateral edges of said first piece of VELCRO strapping folded about said body of said elongated piece in apposition to one another;

h. a second piece of VELCRO strapping that folds about said body of said elongated piece;

i. a second piece of VELCRO hooking material to hold the two lateral edges of said second piece of VELCRO strapping folded about said body of said elongated piece in apposition to one another.

2. The shot on goal practice aid of claim 1 whereby said weighted material is placed in a permanently sealed bag which said permanently sealed bag containing said weighted material is then placed into said pouch in lieu of said weighted material alone.

3. A shot on goal practice aid, comprising:

a. a two-ended elongated piece of heavy cordura nylon material a top end of which is in the form of a closed loop and a bottom end of which is flat with the length of the body of said elongated piece between both ends being longer in measure than the perimeter of said top end;

b. a first line of stitching serving to completely stitch the lowest portion of the first one of the two long edges of said body of said elongated piece to a higher portion of said first one of the said two long edges of said body of said elongated piece after folding said lowest portion up against said higher portion;

c. a second line of stitching parallel to said first line of stitching serving to completely stitch the lowest portion of the second one of the said two long edges of said body of said elongated piece to a higher portion of said second one of said two long edges of said body of said elongated piece piece after folding said lowest portion of said second one of the said two long edges up against said higher portion of said second one of the said two long edges;

d. weighted material placed into the pouch formed by said first line of stitching and said second line of stitching;

e. a third line of stitching perpendicular to and abutting the said first line of stitching and perpendicular to and abutting the said second line of stitching which said third line of stitching serves to permanently close said pouch containing said weighted material;

f. a first piece of VELCRO strapping that folds about said body of said elongated piece;

g. a first piece of VELCRO hooking material to hold the two lateral edges of said first piece of VELCRO strapping folded about said body of said elongated piece in apposition to one another;

h. a second piece of VELCRO strapping that folds about said body of said elongated piece;

i. a second piece of VELCRO hooking material to hold the two lateral edges of said second piece of VELCRO strapping folded about said body of said elongated piece in apposition to one another.

4. The shot on goal practice aid of claim 3 whereby said weighted material is placed in a permanently sealed bag which said permanently sealed bag containing said weighted material is then placed into said pouch in lieu of said weighted material alone.

5. A shot on goal practice aid, comprising:

a. a two-ended elongated piece of nylon material a top end of which is in the form of a closed loop and a bottom end of which is flat with the length of the body of said elongated piece between both ends being longer in measure than the perimeter of said top end;

b. a first line of stitching serving to completely stitch the lowest portion of the first one of the two long edges of said body of said elongated piece to a higher portion of said first one of the said two long edges of said body of said elongated piece after folding said lowest portion up against said higher portion;

c. a second line of stitching parallel to said first line of stitching serving to completely stitch the lowest portion of the second one of the said two long edges of said body of said elongated piece to a higher portion of said second one of said two long edges of said body of said elongated piece piece after folding said lowest portion of said second one of the said two long edges up against said higher portion of said second one of the said two long edges;

d. weighted material placed into the pouch formed by said first line of stitching and said second line of stitching;

e. a third line of stitching perpendicular to and abutting the said first line of stitching and perpendicular to and abutting the said second line of stitching which said third line of stitching serves to permanently close said pouch containing said weighted material;

f. a first piece of VELCRO strapping that folds about said body of said elongated piece;

g. a first piece of VELCRO hooking material to hold the two lateral edges of said first piece of VELCRO strapping folded about said body of said elongated piece in apposition to one another;

h. a second piece of VELCRO strapping that folds about said body of said elongated piece;

i. a second piece of VELCRO hooking material to hold the two lateral edges of said second piece of VELCRO strapping folded about said body of said elongated piece in apposition to one another.

6. The shot on goal practice aid of claim 5 whereby said weighted material is placed in a permanently sealed bag which said permanently sealed bag containing said weighted material is then placed into said pouch in lieu of said weighted material alone.

* * * * *